United States Patent [19]

Gill et al.

[11] 4,338,363

[45] Jul. 6, 1982

[54] METHOD FOR INHIBITING THE FORMATION OF SCALE

[75] Inventors: Jasbir S. Gill, Coraopolis, Pa.; George H. Nancollas, Williamsville, N.Y.

[73] Assignee: The Research Foundation of State University of New York, Albany, N.Y.

[21] Appl. No.: 234,476

[22] Filed: Feb. 17, 1981

[51] Int. Cl.[3] ..... B05D 3/02

[52] U.S. Cl. ..... 427/387; 106/14.05; 252/180; 252/384; 252/407; 427/388.2; 428/447; 428/450

[58] Field of Search ..... 427/387, 388.2; 252/180, 384, 407; 428/447, 450; 106/14.05

[56] References Cited

U.S. PATENT DOCUMENTS 2,723,211 11/1955 MacMullen et al. ..... 427/387

FOREIGN PATENT DOCUMENTS 1264228 2/1972 United Kingdom ..... 427/387

*Primary Examiner*—Michael R. Lusignan

*Attorney, Agent, or Firm*—Michael L. Dunn

[57] ABSTRACT

A method for inhibiting the formation of scale upon metallic heat exchanger surfaces exposed to water solution containing a supersaturated concentration of at least one alkaline earth metal salt at the surface temperature of the heat exchanger. The method comprises using, as the exchanger surface, a corrosion resistant metal surface coated with a film of methylene siliconedichloride.

14 Claims, 1 Drawing Figure

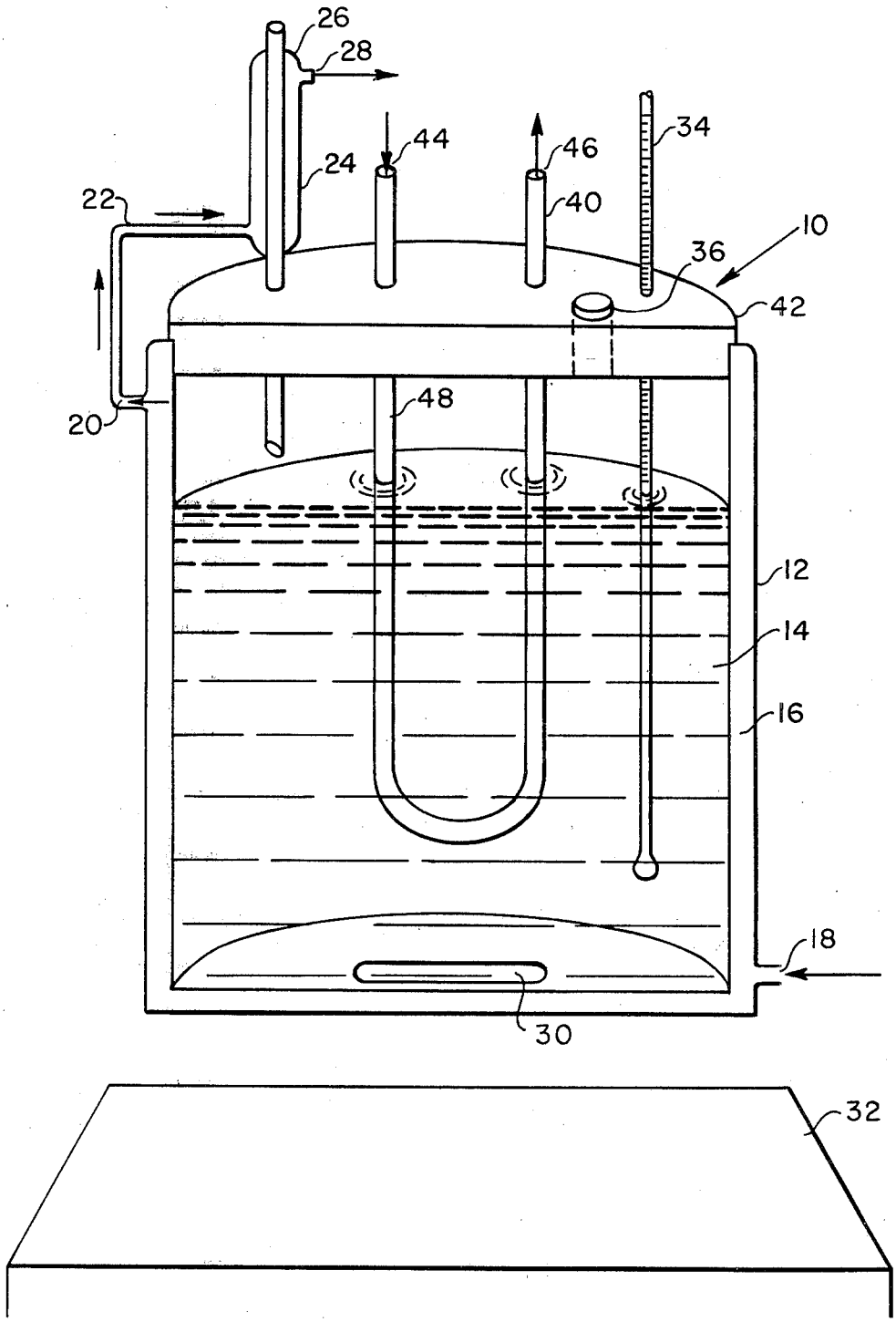
26
28
44
46
34
24
40
22
10
36
42
48
20
12
14
16
18
30
32

METHOD FOR INHIBITING THE FORMATION OF SCALE

BACKGROUND OF THE INVENTION

1. Field of the Invention

This invention relates to the inhibition of formation of scale from water containing scale forming minerals and more particularly relates to a method for inhibiting such scale by treating surfaces which are in contact with such water.

2. History of the Prior Art

The formation of scale from water containing minerals has been a historical problem and has especially been a problem when the water passes over surfaces having temperatures different than the water. Scale has especially been a problem when such water contacts heat exchangers which are either hotter or colder than the water passing through the exchanger. In such cases, when the heat exchanger surface is at a temperature which causes the water at the surface to be supersaturated with minerals, scale deposition is very rapid and cleaning or replacement of the heat exchangers is often necessary since the scale greatly restricts and sometimes entirely stops the flow of water through the exchanger. Furthermore, even when only a only thin layer of scale is deposited, the efficiency of the heat exchanger is greatly reduced since heat must travel through the scale as well as through the wall of the heat exchanger in order to accomplish the heat transfer function.

The formation of calcium sulfate scale in the exchangers, such as encountered in geothermal applications, evaporative desalination, cooling towers and petroleum engineering is an especially serious problem. Such scales are many times in the form of hard crystalline deposits and have been difficult to inhibit. The problem with calcium sulfate scale formation is made worse by a decreasing solubility of calcium sulfate, with increasing temperature.

Numerous attempts have been made to inhibit the formation of mineral scales on heat exchanger surfaces. These attempts have been more or less successful. Scale inhibiting chemicals have, for example, been dissolved in the water which contacts the heat exchanger. Examples of such chemicals are organic polyphosphonates and polyacrylates. The addition of such chemicals has serious disadvantages since such inhibition methods are not entirely successful and the heat exchangers must, nevertheless, continue to be cleaned or replaced more frequently than desirable. Furthermore, continuously supplying scale inhibiting chemicals to the water is wasteful of these chemicals, costly and requires monitoring to be certain that concentrations of scale inhibiting chemicals is sufficiently high.

There also have been attempts made to prevent scale upon heat exchanger surfaces by coating the surfaces with a substance having low surface energy such as polytetrafluoroethylene or silicones such as polydimethylsiloxane. Unfortunately, such polymeric materials form films which are sufficiently thick to reduce the efficiency of the heat exchangers by causing an insulation effect at the exchanger surface.

Other attempts at coating such heating exchanger surfaces have been made utilizing various kinds of oils which unfortunately rapidly wear from the surface thus leaving the exposed exchanger surface susceptible to scale deposition.

BRIEF DESCRIPTION OF THE FIGURE

The FIGURE is a cross-sectional elevational view of an apparatus for testing the method of the invention.

BREIF DESCRIPTION OF THE INVENTION

In accordance with the present invention, there is provided a method for inhibiting the formation of scale upon metallic surfaces, especially heat exchanger surfaces, exposed to a water solution containing a supersaturated concentration of at least 1 alkaline earth metal salt at the surface temperature of the heat exchanger. The method comprises utilizing, as the exchanger surface, a corrosion resistant metal surface coated with a film of methylene siliconedichloride.

In general, the metal surface is coated with the film of methylene siliconedichloride by covering the surface with methylene siliconedichloride or a solution of the methylene siliconedichloride followed by removing all excess non-adherent methylene siliconedichloride from the surface. The covering of the surface may be accomplished by any suitable means such as immersion or painting. It is believed that the removal of excess non-adherent methylene siliconedichloride results in residual monomolecular layer.

Desirably, after coating, the coated metal surface is heated to from about 50° C. to about 200° C. for from about 5 to about 180 minutes and preferably from about 90° to about 150° C. for from about 20 to about 150 minutes.

The method of the invention is advantageous to inhibit scale where the scale inhibited has a solubility in water which either increases or decreases with increasing water temperature and wherein the metallic heat exchanger surface is either hotter or colder than the water solution to which it is exposed.

DETAILED DESCRIPTION OF THE INVENTION

The present invention is a method for inhibiting the formation of scale upon metallic heat exchanger surfaces. The invention is not intended to include metal surfaces treated with methylene siliconedichloride since treatment of metal surfaces with methylene siliconedichloride is known for other purposes.

"Inhibiting", as used herein, means stopping or slowing down of scale formation. "Scale" means any mineral deposit from water solutions whether the scale is formed as a result of increasing water temperature at the heat exchanger surface, decreasing water temperature at the heat exchanger surface or otherwise.

"Heat exchanger surface", as used herein, means the surface of any heat exchanger exposed to water. "Heat exchanger" is intended to include, but not be limited to, radiators, boiler tubes and heating and cooling elements and coils for transfering heat from one medium to another wherein at least one of the media is water. "Water" includes water solutions.

In accordance with the method of the invention, the heat exchanger surface in contact with the water is a corrosion resistant metal surface coated with a film of methylene siliconedichloride. The metal surface may be of any corrosion resistant metal including, but not necessarily limited to stainless steel, chromium, nickel, titanium, copper and brass.

"Methylene siliconedichloride", as used herein, is intended to include compounds having the following formula:

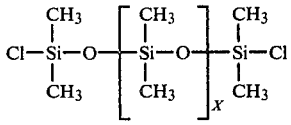

where X is 1 to 4.

The preferred methylene siliconedichloride is the compound wherein X is 2 having the chemical name dichlorooctamethyltetrasiloxane.

In coating the metal surface with methylene siliconedichloride, the metal surface is completely covered with a methylene siliconedichloride in either diluted or undiluted form. Suitable solvents for the methylene siliconedichloride are carbon tetrachloride, acetone, toluene, methylene chloride and hexane. The methylene siliconedichloride should not be diluted by more than from about 1 to about 10 percent with the solvent and the solvents should be clean and dry. Esters and alcohols should not be used as solvents. In coating the metal surface of the heat exchanger, the heat exchanger surface may be dipped into the methylene siliconedichloride in undiluted or diluted form or the methylene siliconedichloride may be rubbed or painted onto the clean metal surface. The surface should then be rubbed dry to remove all excess non-adherent methylene siliconedichloride.

While it is not essential, the coated metal surface may then be heat treated which appears to somewhat enhance durability of the coating. In heat treating, the metal surface is heated to from about 50° C. to about 200° C., preferably from about 90° to about 150° C. for from about 5 to about 180 minutes, preferably for from about 20 to about 150 minutes.

The resulting film is in general a monomolecular layer of methylene siliconedichloride which seems to be integrally bound to the metal surface. This monomolecular layer is highly desirable since it does not significantly interfere with heat transfer efficiency of the heat exchanger.

As previously discussed, the method of the invention effectively inhibits scale which has a solubility in water which decreases with increasing water temperature and wherein the metallic heat exchanger surface is hotter than the water solution to which it is exposed before the water is warmed by the heat exchanger. In general, in such cases, the surface of the heat exchanger in contact with the water containing dissolved minerals is at a temperature from about 50° to about 200° C., often from about 50° to about 120° C., and the temperature of the water solution is at a temperature of from about 0° to about 100° C. and usually from about 10° to about 60° C. An example of an alkaline earth metal salt which has decreasing solubility with increasing water temperature is calcium sulfate. Calcium sulfate, as used herein, is intended to include both anhydrous calcium sulfate $CaSO_4$) and calcium sulfate hydrates ($CaSO_4.xH_2O$).

The method of the invention is also effective wherein the scale inhibited has a solubility in water which decreases with decreasing water temperature and the metallic heat exchanger surface is colder than the water solution to which it is exposed before the water is cooled by the heat exchanger. In these cases, the metal surface is usually at a temperature from about 0° to about 70° C., usually from about 10° to about 60° C., and the temperature of the water solution is at a temperature of from about 50° to about 200° C. and usually from about 50° to about 120° C. Examples of alkaline earth metal salts whose solubility decreases with decreasing water temperature are barium sulfate and hydroxyapatite.

The temperature difference between the metallic surface and the water solution is usually from about 40° to about 100° C., whether the metallic surface is hot or cold with respect to the water solution.

Other scales which are inhibited in accordance with the method of the invention are the carbonates of alkaline earth metals such as calcium and barium carbonates.

The following example serves to illustrate and not limit the invention. Unless otherwise indicated, all parts and percentages are by weight.

EXAMPLE 1

Metal tubes are tested for their scale inhibiting properties when used in heat exchanger applications in accordance with the method of the invention. A cross sectional view of an apparatus essentially the same as the apparatus used in accordance with the examples, is set forth in the drawing.

Referring to the FIGURE, the apparatus 10 comprises a jacketed container 12 which contains a solution 14 of a scale forming alkaline earth metal salt. Solution 14 is kept cool by water circulating through jacket 16 which enters into the jacket at opening 18 and leaves the jacket at opening 20. Water entering at opening 18 into jacket 16 is maintained at about 4° C. so that solution 14 is similarly maintained near 4° C. The water leaving the jacket at orifice 20 passes through connecting tube 22 and into jacket 24 of water cooled condenser 26. The water leaves water cooled condenser 26 at opening 28. The bottom of jacketed container 12 is provided with magnetic bar 30 which is rotated by means of magnetic stirrer 32. In operation, jacketed container 12 rests upon the upper surface of magnetic stirrer 32. The rotation of magnetic bar 30 maintains a uniform temperature throughout the main body of solution 14. The temperature is monitored by means of thermometer 34 and if desired, solution 14 can be tested through sampling port 36.

Tube 40 being tested passes through the cover 42 of container 12 into solution 14. The tube being tested is maintained at a temperature substantially hotter than the main body of solution 14 by means of water entering the tube at position 44 and leaving at position 46. In general, water passing through tube 40 is maintained at about 70° C. The outside surface 48 of tube 40 is the surface which is coated with methylene siliconedichloride as previously described followed by baking at 110° C.

In accordance with this example, calcium sulfate is used as the dissolved salt and is initially provided at a concentration of about $3\times10^{-2}$ moles by adding appropriate concentrations of calcium chloride and sodium sulfate to the solution. Periodically, during testing of the tube 40 for scale inhibition, samples are taken through sampling port 36 and the samples are titrated for calcium concentration with EDTA. The lower the calcium concentration relative to the initial $3\times10^{-2}$ molar concentration, the greater the amount of scale which has been deposited upon tube 40. Since calcium sulfate has a solubility which decreases with increasing temperature, essentially all scale which is deposited, will deposit upon the surface of tube 40 since the surface of tube 40 is hot relative to the temperature of solution 14. In accordance with this example, the tube is manufactured of 304 stainless steel. The tube is covered with methylene siliconedichloride (X=2) and the excess is wiped off. The tube is baked at 110° C. for 2 hours. The results are set forth in Table I.

TABLE I

| SAMPLE | TIME HOURS | Ca++ CONCENTRATION |
|---|---|---|
| 1 | zero | $3.018 \times 10^{-2}$ |
| 2 | 1 | $3.016 \times 10^{-2}$ |
| 3 | 2 | $3.020 \times 10^{-2}$ |
| 4 | 3 | $3.016 \times 10^{-2}$ |
| 5 | 5 | $3.001 \times 10^{-2}$ |
| 6 | 7 | $3.102 \times 10^{-2}$ |
| 7 | 25 | $3.015 \times 10^{-2}$ |
| 8 | 32 | $3.090 \times 10^{-2}$ |
| 9 | 48 | $3.003 \times 10^{-2}$ |
| 10 | 96 | $2.988 \times 10^{-2}$ |
| 11 | 147 | $3.013 \times 10^{-2}$ |

Testing of a 304 stainless steel tube which has not been coated with methylene siliconedichloride in accorance with the present invention, results in calcium ion concentrations in solution 14 of about $2.95 \times 10^{-2}$ at 1 hour, $2.8 \times 10^{-2}$ at 2 hours, $2.7 \times 10^{-2}$ at 3 hours, $2.6 \times 10^{-2}$ at 4 hours, $2.5 \times 10^{-2}$ at 5 hours and $2.45 \times 10^{-2}$ at 7 hours. Table I therefore clearly demonstrates the effectiveness of the method of the invention which clearly inhibits deposition of calcium sulfate scale.

The apparatus of the invention can readily be used to test for scale inhibition of salts whose solubility decreases with decreasing temperature by placing a hot solution in container 12 and maintaining the solution at a hot condition by circulating hot water through jacket 16. A tube would then be maintained at a cold condition relative to the temperature of the solution by circulating cold water through the tube.

What is claimed is:

1. A method for inhibiting the formation of scale upon metallic heat exchanger surfaces exposed to water solution containing a supersaturated concentration of at least one alkaline earth metal salt at the surface temperature of the heat exchanger, said method comprising utilizing, as the exchanger surface, a corrosion resistant metal surface coated with a film of methylene siliconedichloride.

2. The method of claim 1 wherein the metal surface is coated with said film by covering the surface with methylene siliconedichloride or a solution of the methylene siliconedichloride followed by removing all excess non-adherent methylene siliconedichloride from said surface.

3. The method of claim 2 wherein after coating, the coated metal surface is heated to from about 50° C. to about 200° C. for from about 5 to about 180 minutes.

4. The method of claim 3 wherein the film is a monomolecular layer.

5. The method of claim 3 wherein, after coating, the coated metal surface is heated to from about 90° to about 150° C. for from about 20 to about 150 minutes.

6. The method of claim 3 wherein the scale inhibited has a solubility in water which decreases with increasing water temperature and the metallic heat exchanger surface is hotter than the water solution to which it is exposed before said water is warmed by said heat exchanger.

7. The method of claim 6 wherein the metallic surface is at a temperature of from about 50° to about 200° C. and the temperature of the water solution is at a temperature of from 0° to about 100° C.

8. The method of claim 7 wherein the metallic surface is at a temperature of from about 50° to about 120° C., the solution is at a temperature of from about 10° to about 60° C. and the difference between the temperature of the metallic surface and the temperature of the water solution is from about 40° to about 100° C.

9. The method of claim 7 wherein the alkaline earth metal salt is calcium sulfate.

10. The method of claim 3 wherein the scale inhibited has a solubility in water which decreases with decreasing water temperature and the metallic heat exchanger surface is colder than the water solution to which it is exposed before said water is cooled by said heat exchanger.

11. The method of claim 10 wherein the metallic surface is at a temperature of from about 0° to about 70° C. and the temperature of the water solution is at a temperature of from about 50° to about 200° C.

12. The method of claim 11 wherein the metallic surface is at a temperature of from about 10° to about 60° C., the water solution is at a temperature of from about 50° to about 120° C., and the difference between the temperature of the metallic surface and the temperature of the water solution is from about 40° to about 100° C.

13. The method of claim 10 wherein the alkaline earth metal salt is barium sulfate or hydroxyapatite.

14. The method of claim 1 wherein the metal surface is a metal selected from the group consisting of stainless steel, chromium, nickel, titanium, copper and brass.

* * * * *